US006209754B1

(12) United States Patent
Suzumi

(10) Patent No.: US 6,209,754 B1
(45) Date of Patent: Apr. 3, 2001

(54) POUCH

(75) Inventor: Hideya Suzumi, Tokyo (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 09/412,601

(22) Filed: Oct. 6, 1999

(30) Foreign Application Priority Data

Oct. 27, 1998 (JP) ..... 10-305274
Jun. 15, 1999 (JP) ..... 11-168920

(51) Int. Cl.[7] ..... B65D 35/08
(52) U.S. Cl. ..... 222/92; 222/107
(58) Field of Search ..... 222/92, 105, 107

(56) References Cited

U.S. PATENT DOCUMENTS 2,723,779 * 11/1955 Parker et al. ..... 222/107 X
4,717,046 * 1/1988 Brogli ..... 222/107
4,792,060 * 12/1988 Brogli ..... 222/107
4,998,646 * 3/1991 Sherman ..... 222/107

FOREIGN PATENT DOCUMENTS 296 22 147 U 4/1997 (DE) .
0 630 822 12/1994 (EP) .
2 278 338 11/1994 (GB) .
7-2260 1/1995 (JP) .

* cited by examiner

*Primary Examiner*—Kenneth Bomberg
(74) *Attorney, Agent, or Firm*—Oblon, Spivak, McClelland, Maier & Neustadt, P.C.

(57) ABSTRACT

A pouch has two side-wall films overlaid with each other with a pour opening, wherein each of the side-wall films is provided with a reinforcement. The reinforcements are arranged in an unsymmetrical manner towards the pouring direction and are formed in a curved line.

4 Claims, 2 Drawing Sheets

POUCH

BACKGROUND OF THE INVENTION

1. Field of the Invention

This invention relates to a pouch having an improved pour opening.

2. Description of Related Art

Japanese Laid-Open Patent No. 7-2260 discloses a pouch having a reinforcement comprising a linear shaping of foil in the region of a pour opening to prevent the pour opening from being choked up when liquid is poured.

The reinforcement, however, is arranged in such a manner that two foils constituting a free standing pouch are provided with two reinforcements which lie in alignment with one another, i.e., symmetrically. Therefore, the pour opening tends to be choked and steady pouring of the contents is often failed.

A conventional self-supporting pouch comprises a bag-like portion formed by adhering films with a pour opening sealed portion located at the upper part of the bag-like portion. When the self-supporting pouch is filled with liquid and allowed to stand, while the outer shape is stably maintained from the middle part immediately under the liquid surface to the bottom part of the bag-like portion due to the liquid pressure of the contents, the outer shape from the middle part to top portion of the bag-like portion tends to give wrinkle or intake, thus exhibiting unsatisfied self-supporting property.

In addition, when holding the self-supporting pouch to pour the contained liquid from its pour opening, the bag-like portion tends to bend and deform at the connected portion between the side sealed portion and the pour opening sealed portion thereby impairing the holding property.

SUMMARY OF THE INVENTION

An object of the present invention is to provide a pouch which is easy to process for shaping a pour opening and is capable of pouring the contents towards steady direction without occurring the choke.

Another object of the present invention is to improve the self-supporting property and the pouch-holding property.

The present invention has achieved the above-mentioned object by providing a pouch comprising two side-wall films overlaid with each other with a pour opening, wherein the side-wall films each are provided with a reinforcement, the reinforcements being arranged in an unsymmetrical manner towards pouring direction.

In addition, the present invention has achieved the above-mentioned object by providing the pouch wherein the two side-wall films are adhered to each other to form a bag-like portion, a side portion of the bag-like portion is provided with a side-sealed portion, a pour opening sealed portion is provided with an upper corner connected with the side-sealed portion, the sealed width of the side-sealed portion being enlarged upwardly, and the side-sealed portion and the pour opening sealed portion being continuously connected with a curved line sealed portion.

According to the pouch of the present invention, it is easy to shape the pour opening, and the contents can be steadily poured without choke.

In addition, if the sealed width of a side-sealed portion is enlarged toward the upper direction and the side-sealed portion and the pour opening sealed portion are connected in a continuous manner by a curved sealed portion, the self-supporting property and pouch-holding property can be enhanced.

DETAILED DESCRIPTION OF THE INVENTION

Figure 1:
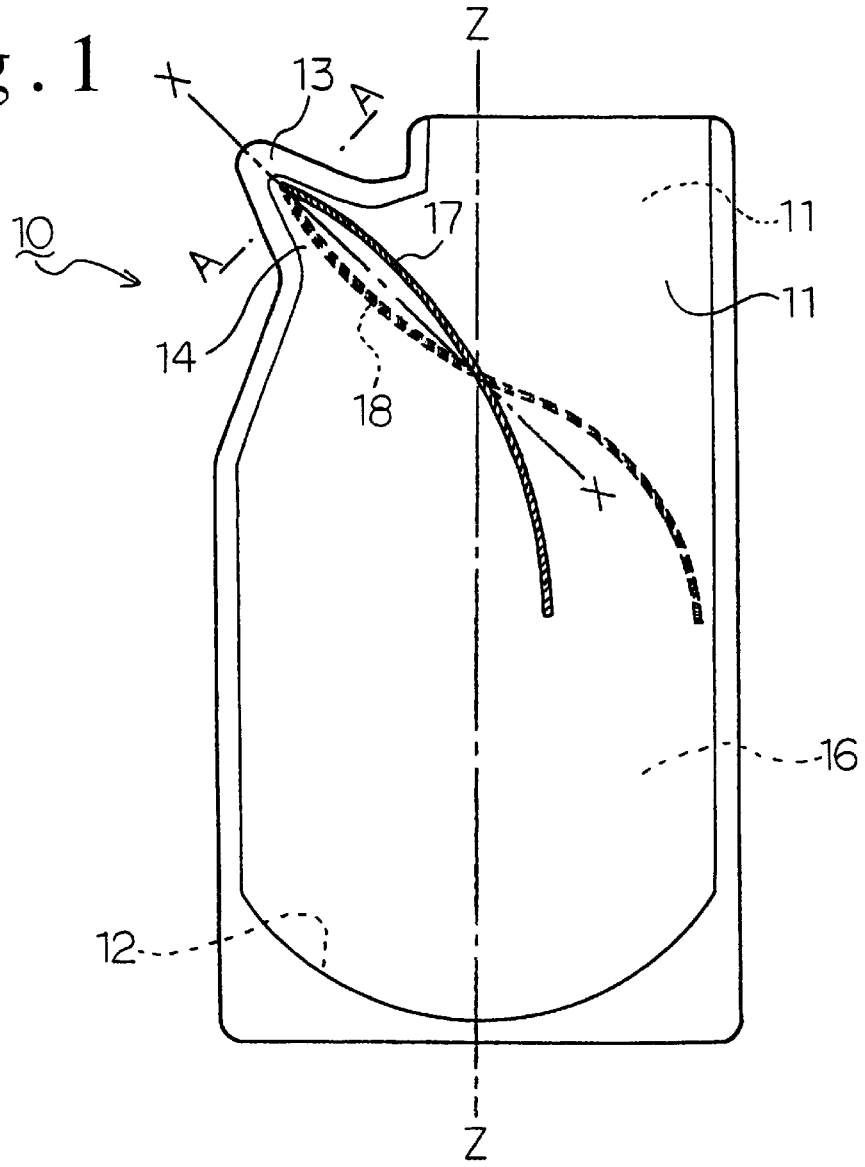
FIG. 1 is a plan view showing a self-supporting pouch in relation to one embodiment of the present invention.

As shown in FIG. 1, in a self-supporting pouch 10 which is a preferred embodiment of the present invention, a pair of side-wall films 11 and a bottom-wall film 12 both comprising a plastic film material such as polyethylene are sealed at the edge portions thereof for uniting into one body in a shape of a bag to thereby form a portion 16 for containing liquid. At an upper-end corner of the pouch 10, a pouring member 13 projecting from the edge portion upwardly in slant is arranged. When the distal end part of the pouring member 13 is cut along the line A—A, a pour opening 14 is projectedly formed with its distal end opening.

In the pour opening 14, one side of the pair of side-wall films 11 (this side seen in FIG. 1) is provided with a first reinforcement line 17 in a form convex in section which is biased upwardly from the center line X—X and extends in a curve, and the other side of the pair of side-wall film 11 (the other side unseen in FIG. 1) is provided with a second reinforcement line 18 in a form convex in section which is biased downwardly from the center line X—X and extends in a curve.

The first reinforcement line 17 curves in a convex line off to the upper direction and further extends beyond the longitudinal center line Z—Z.

The second reinforcement line 18 first curves in a concave line off to the lower direction, changes at the point where it crosses the longitudinal center line Z—Z of the side-wall film 11 into a convex line curved off to the upper direction, and then further extends to form an S curve. The terminal end of the second reinforcement line 18 locates near the side edge part in the approximately central region of the body portion of the self-supporting pouch 10.

The first reinforcement line 17 and the second reinforcement line 18 cross near the longitudinal center line Z—Z.

The convex form in section of the first reinforcement line 17 and the second reinforcement line 18 is easily formed as the linear reinforcement in a outwardly convexed form in section, for example, by pressing the side wall film 11 in a groove of an anvil using heated male and female stamps or by heat-sealing, without arranging them in a symmetrical manner. In addition, these reinforcement lines 17, 18, for example, may be formed into a projection of an arch form in section by pressure molding.

Figure 2:
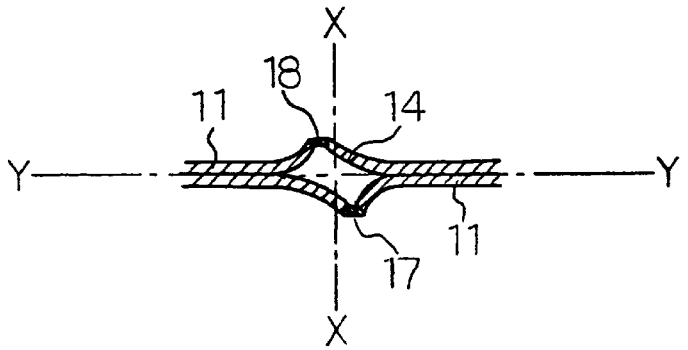
FIG. 2 is a cross-sectional view taken along line A—A of FIG. 1 showing the opening condition of the pour opening.

According to this embodiment, as shown in FIG. 2, the reinforcement lines 17, 18 which are located in an unsymmetrical manner on the opposite sides of the center line X—X with respect to the symmetrical axis of the sealed center line Y—Y of the side-wall films 11 let the pour opening 14 to open with changing the direction of force which is applied to the surface and back side of the side-wall film 11. This construction facilitates the opening of the pour opening 14 at the pouring to thereby efficiently prevent the choking of the pour opening 14. According to the unsymmetrical relation between the first reinforcement line 17 and the second reinforcement line 18, a twisted imaginary channel is formed at the pour opening 14 so that the contents flow in a twisted condition and the steady pouring direction is maintained, thus improving the pouring performance.

In addition, according to this embodiment, the first reinforcement line 17 and the second reinforcement line 18 at the pour opening 14 curve towards the different side to each other with respect to the center line X—X, so that the contents are poured in spiral, and the pouring performance and the flowing direction are further stabilized.

Further, according to this embodiment, the first reinforcement line 17 and the second reinforcement line 18 extend beyond the longitudinal center line Z—Z of each side-wall film 11 to the approximately central region of the body portion of the self-supporting pouch 10, so that the force which is given by the weight of the contents to push and expand the body portion is directed to the pour opening 14 through the reinforcement lines 17, 18, and converted into the force for opening the pour opening 14, thus more effectively preventing the choking of the pour opening 14 and improving the pouring performance.

Furthermore, the reinforcement lines 17, 18 extend to the approximately central region of the body portion of the self-supporting pouch 10, so that the rigidity of the pouch is enhanced, the pouch-holding property by hands is improved, and self-supporting property is enforced. Besides, the outer appearance of the self-supporting pouch 10 is improved, and the reinforcement lines serve as an accent line of the pour opening 14 and a holding guide.

Figure 3:
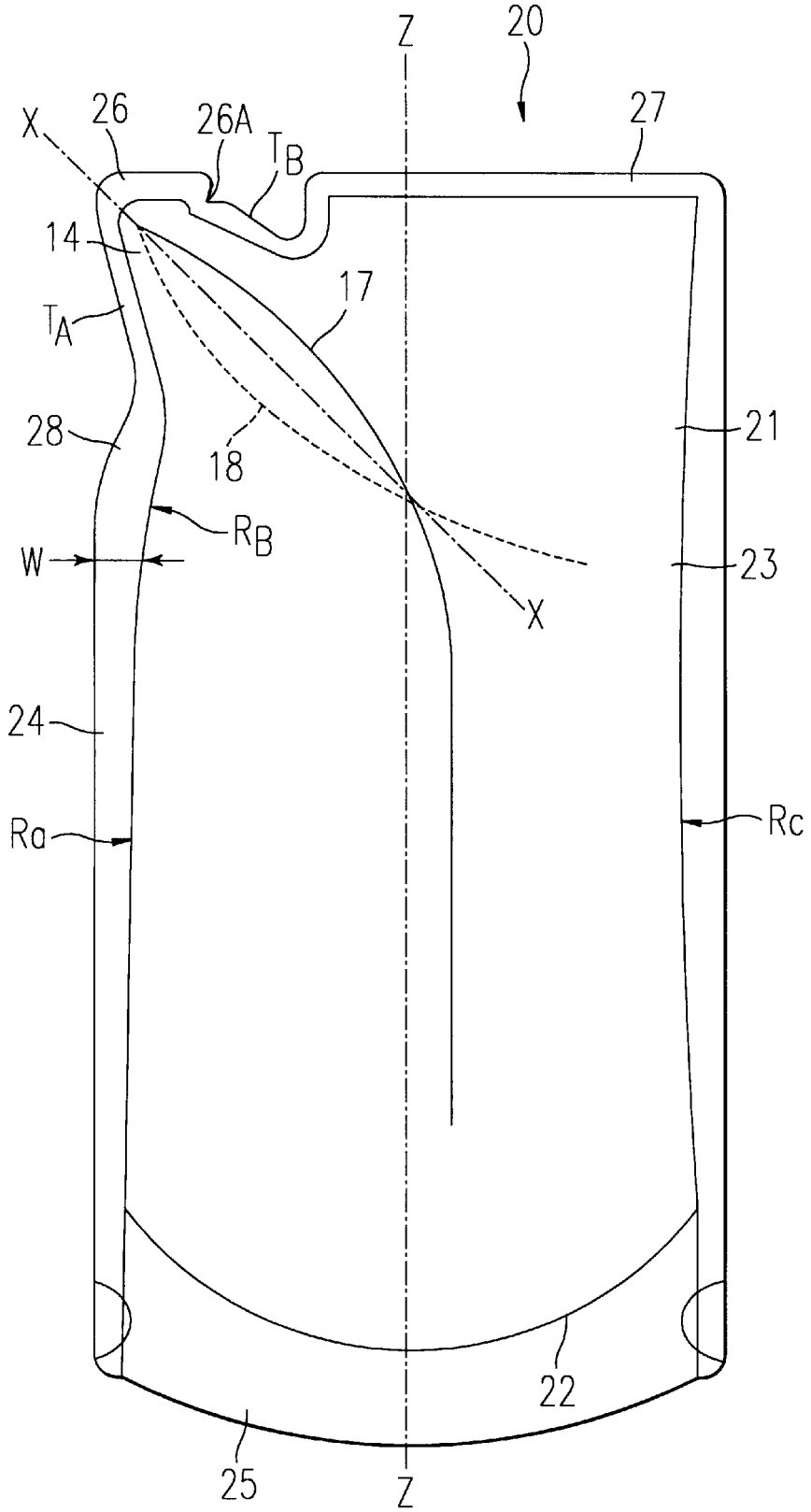
FIG. 3 is a plan view showing a self-supporting pouch in relation to another embodiment of a present invention.

FIG. 3 shows a self-supporting pouch 20 in relation to another embodiment of the present invention, in which two side-wall films 21 and one bottom film 22 form a bag-like portion 23 as a containing portion. Films 21 and 22 may be a laminate sheet of plastic.

In the self-supporting pouch 20, two side-wall films 21 are heat-sealed at respective side edge portions to form a side-sealed portion 24 on both sides of the bag-like portion 23, and the opposite outer edge portions of the two-folded bottom films 22 are heat-sealed to the bottom edge portion of two side-wall films 21 respectively to thereby form a bottom-sealed portion 25. A pour opening sealed portion 26 is formed at an upper corner of the one side of the bag-like portion 23 connected to the side-sealed portion 24. After the contents are filled from the opening portion of the top of the bag-like portion 23 of the self-supporting pouch 20, the upper edge portion of the two side-wall films 21 are heat-sealed with each other to thereby form a top-sealed portion 27 of the bag-like portion 23.

When the two-folded bottom wall film 22 is developed, the bag-like portion 23 of the self-supporting pouch 20 can be free-standing. In actual use of the self-supporting pouch 20, the pour opening sealed portion 26 can be torn and opened with a notch 26A of the pour opening sealed portion 26 to thereby form the pour opening for pouring the contents.

Therefore, in connection with the self-supporting pouch 20, as in the self-supporting pouch 10, the first reinforcement line 17 and the second reinforcement line 18 are formed from the pour opening 14 across the longitudinal center line Z—Z of the side-wall film 21. Besides, at one side where the pour opening sealed portion 26 of the bag-like portion 23 is formed, the side-sealed portion 24 and the pour opening sealed portion 26 are connected in such a manner that, while a sealed width W of at least intermediate portion of the side-sealed portion 24 is enlarged upwardly, the side-sealed portion 24 and the pour opening sealed portion 26 are continuous through a curved line sealed portion 28. At this side of the bag-like portion 23, the outer line of the side-sealed portion 24 becomes linear, the inner line of the side-sealed portion 24 at the part lower than the intermediate portion is formed into a curved line portion (RA) which is convex to the inner side of the pouch, and the inner line thereof at the part upper than that is formed into a curved line portion (RB) which is concave to the inner side of the pouch.

An area of the pour opening sealed portion 26 closer to the side-sealed portion 24 and another area thereof closer to the top-sealed portion 27 are both narrowed as slant line portions (TA, TB) to thereby improve the pouring performance. In addition, the slant line portion TB of the pour opening sealed portion 26 closer to the top-sealed portion 27 is recessed from the top-sealed portion 27, so that the distal edge of the pour opening sealed portion 26 is enabled to be the same level as the extension of the top-sealed portion 27. Thus, in the production of the pouch, the material can be efficiently used.

At the other side of the bag-like portion 23 where the pour opening sealed portion 26 is not provided, the outer line of the side-sealed portion 24 is linear, and the inner line thereof is a curved line portion (RC) which is convex to the inside of the bag.

Therefore, the self-supporting pouch 20 of this embodiment provides the following advantageous effects, in addition to the advantageous effects of the aforementioned self-supporting pouch 10.

(1) When the self-supporting pouch 20 is filled with liquid and allowed to stand, the outer shape of the bag-like portion 23 from the intermediate part immediately under the liquid surface to the bottom portion is stably maintained due to the liquid pressure of the contents. In addition, in this embodiment, the sealed width W of the side-sealed portion 24 of the bag-like portion 23 is enlarged upwardly at least at the intermediate portion to give a wider width, so that the rigidity of the upper portion of the intermediate portion of the bag-like portion 23 is enhanced, thus preventing wrinkle or intake of the self-supporting pouch 20 and exhibiting enhanced self-supporting property.

(2) When the pour opening 14 is opened and the liquid is poured therefrom with holding the self-supporting pouch 20 with hands, force is not concentrated at the connected portion of the side-sealed portion 24 and the pour opening sealed portion 26 of the bag-like portion 23 because this connected portion is in a curved line form (curved line sealed portion 28). As a result, bending or deformation can be prevented, and the holding property of the self-supporting pouch 20 can be improved.

In the opposite side-sealed portions 24 of the bag-like portion 23, both inner lines are curved line portions (RA, RC) bending convexly to the inside of the bag, and the space between the inner lines of the opposite side-sealed portions 24 is minimum at the intermediate portion in the height direction of the bag-like portion 23. Thus, it is possible to ensure the rigidity of the bag-like portion 23.

The present invention is variously modifiable. For example, the first reinforcement line 17 and the second reinforcement line 18 may be linear or a combination of linear lines, may be in the same side of the center line X—X. The curved line or curved direction may be on the same side or on opposite sides. The first reinforcement line 17 and the second reinforcement line 18 may be provided at least in the pour opening 14, and is not always necessary to extend to the central portion of the body portion. The pour opening 14 is not always necessary to project off to the upper direction, and it may project upwardly above the upper edge in the center of the top portion of the pouch or may not project at all.

What is claimed is:

1. A pouch comprising:

two side-wall films overlaid with each other with a pour opening, wherein each of said side-wall films is provided with a reinforcement, each of said reinforcements being arranged in an unsymmetrical manner towards a pouring direction, and wherein said unsymmetrical reinforcements are formed in a curved line.

2. The pouch according to claim 1, wherein said two side-wall films are adhered to each other to form a bag-like portion, a side portion of said bag-like portion is provided with a side-sealed portion, a pour opening sealed portion is provided with an upper corner connected with a side-sealed portion, a sealed width of said side-sealed portion being enlarged upwardly, and said side-sealed portion and said pour opening sealed portion being continuously connected with a curved line sealed portion.

3. The pouch according to claim 1, wherein said reinforcements provided on each of said two side-wall films are across from each other.

4. The pouch according to claim 1, wherein said reinforcements are across a longitudinal center line of said side-wall films and extend to at least a central region of said side-wall films.

* * * * *

UNITED STATES PATENT AND TRADEMARK OFFICE

CERTIFICATE OF CORRECTION

PATENT NO. : 6,209,754 B1
DATED : April 3, 2001
INVENTOR(S) : Suzuki

It is certified that error appears in the above-identified patent and that said Letters Patent is hereby corrected as shown below:

Title page,
Items (12) and (75), the inventor's name is listed incorrectly. Should read as follows:
Items ( 19), -- United States Patent
Suzuki --
-
Item (75), -- Inventor: Hideya Suzuki, Tokyo (JP) --

Signed and Sealed this

Sixteenth Day of October, 2001

*Attest:*

Nicholas P. Godici

NICHOLAS P. GODICI
*Acting Director of the United States Patent and Trademark Office*

*Attesting Officer*